US012207695B2

(12) United States Patent
Wilson

(10) Patent No.: US 12,207,695 B2
(45) Date of Patent: Jan. 28, 2025

(54) HAIR PIECE SECURING APPARATUS

(71) Applicant: Raushanah Wilson, New York, NY (US)

(72) Inventor: Raushanah Wilson, New York, NY (US)

( * ) Notice: Subject to any disclaimer, the term of this patent is extended or adjusted under 35 U.S.C. 154(b) by 238 days.

(21) Appl. No.: 17/235,290

(22) Filed: Apr. 20, 2021

(65) Prior Publication Data

US 2022/0330640 A1 Oct. 20, 2022

(51) Int. Cl.
*A41G 5/00* (2006.01)

(52) U.S. Cl.
CPC ..... *A41G 5/0053* (2013.01)

(58) Field of Classification Search
CPC ..... A41G 5/00; A41G 5/0006; A41G 5/0013; A41G 5/0026; A41G 5/004; A41G 5/0046; A41G 5/0053; A41G 5/006; A41G 5/0073; A41G 5/0093; A41G 3/00; A41G 3/0008; A41G 3/0016; A41G 3/0033; A41G 3/0041; A41G 3/005; A41G 3/0058
See application file for complete search history.

(56) References Cited

U.S. PATENT DOCUMENTS 5,647,384 A 7/1997 Haber et al.
6,012,460 A * 1/2000 Kikuchi ..... A41G 5/0026 132/54
8,720,452 B2 5/2014 Askander et al.
8,991,406 B1 * 3/2015 Salter ..... A41G 3/0016 132/274
9,027,568 B2 * 5/2015 Lee ..... A41G 3/005 132/201
9,179,721 B2 11/2015 Hines et al.
2010/0170523 A1 7/2010 DePalma
2010/0326455 A1 12/2010 Karsenti et al.
2015/0114415 A1 * 4/2015 Hines ..... A41G 3/0041 132/54
2015/0327609 A1 * 11/2015 Suh ..... A41G 3/0075 132/54
2017/0215506 A1 * 8/2017 Sim ..... A41G 3/0066
2019/0059486 A1 * 2/2019 Kim ..... A41G 3/005
2020/0015532 A1 * 1/2020 Geisinsky ..... A41G 3/0016
2021/0085008 A1 * 3/2021 Thomas ..... A41G 3/0016
2021/0112900 A1 * 4/2021 Staky ..... A41G 5/0073
2021/0177079 A1 * 6/2021 Kim ..... A41G 3/0016

* cited by examiner

*Primary Examiner* — Cris L. Rodriguez
*Assistant Examiner* — Karim Asqiriba
(74) *Attorney, Agent, or Firm* — Venable LLP; Ryan T. Ward

(57) ABSTRACT

Disclosed herein are embodiments of a hair piece securing apparatus enabling the consumer to wear a hair piece without the hair piece slipping off or moving around the head. The hair piece apparatus can have a multitude of attachment systems that enable a more secure attachment of the hair piece to the person's head, while providing a custom fit for every individual.

18 Claims, 5 Drawing Sheets

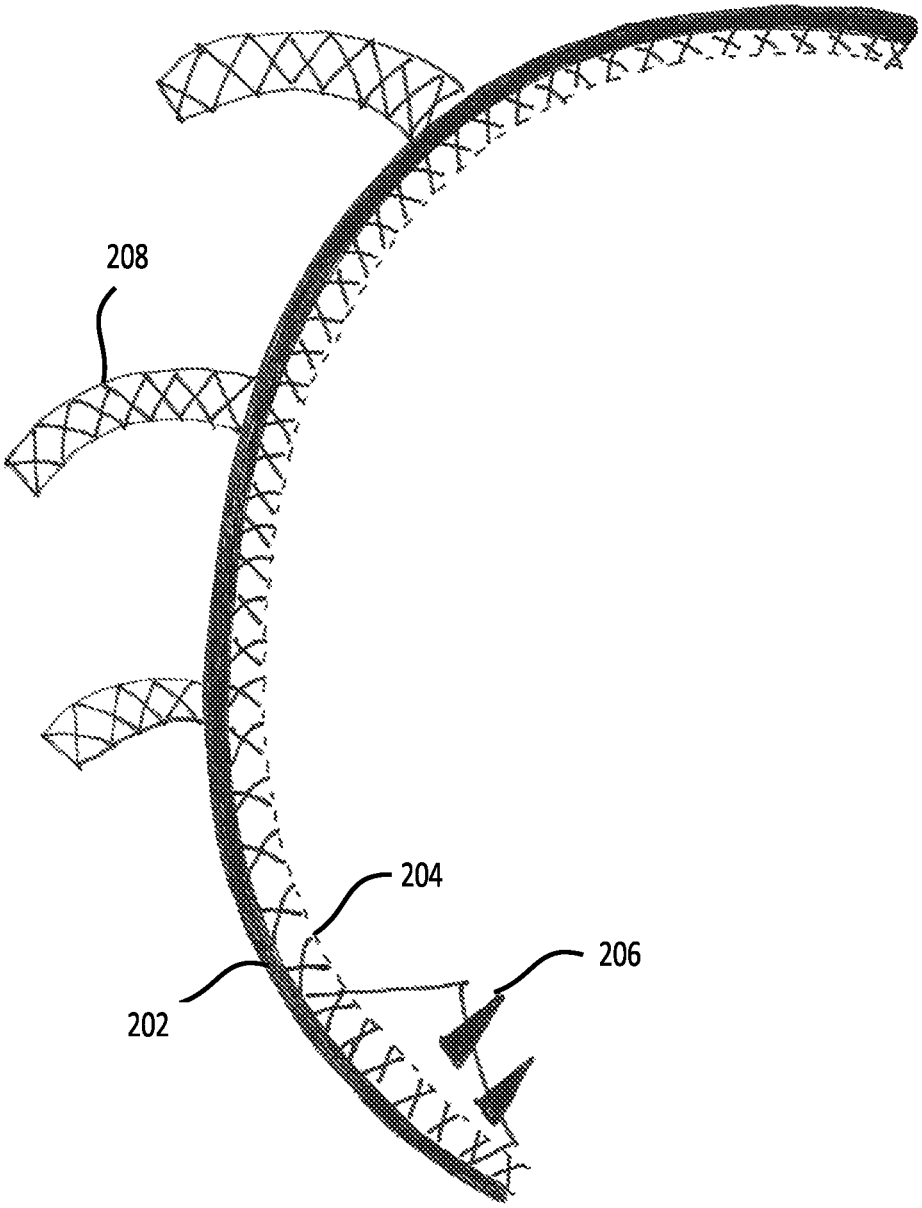
FIG. 2. A.

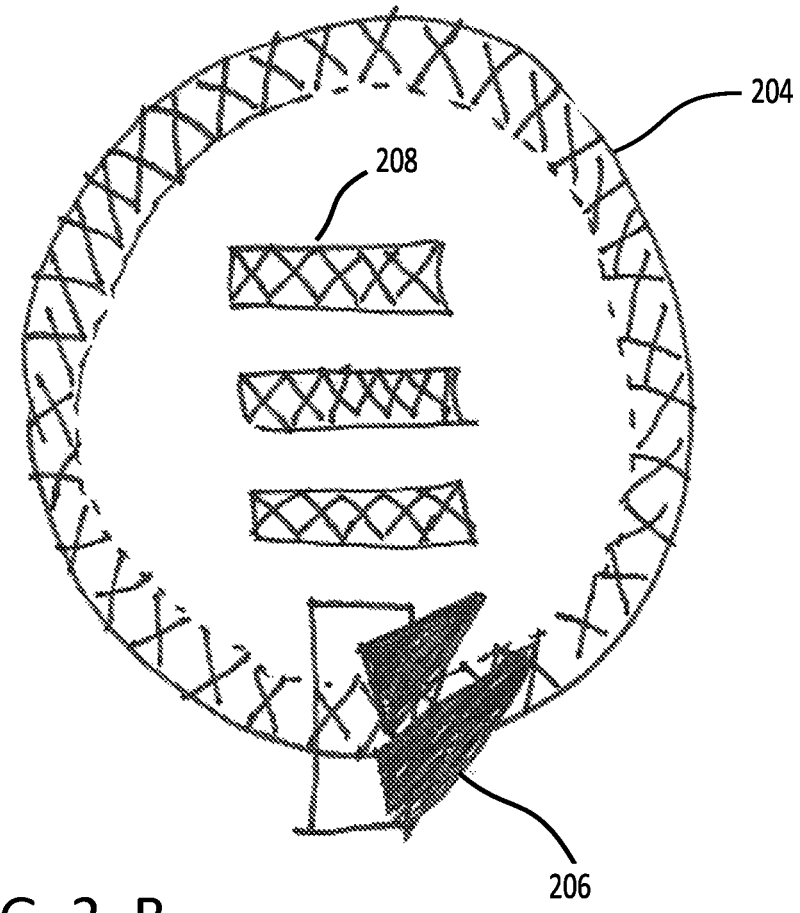
FIG. 2. B.

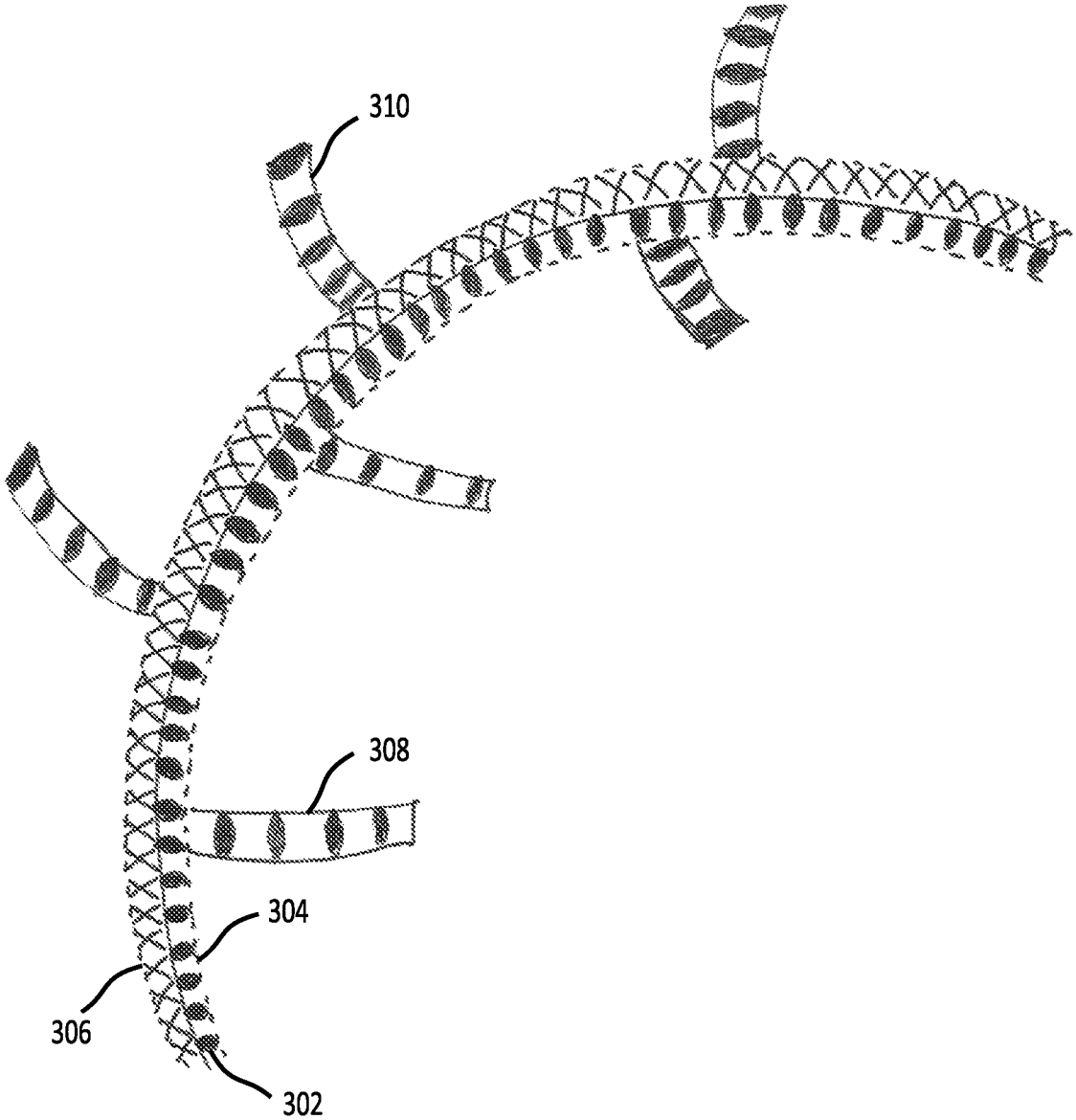
FIG. 3. A.

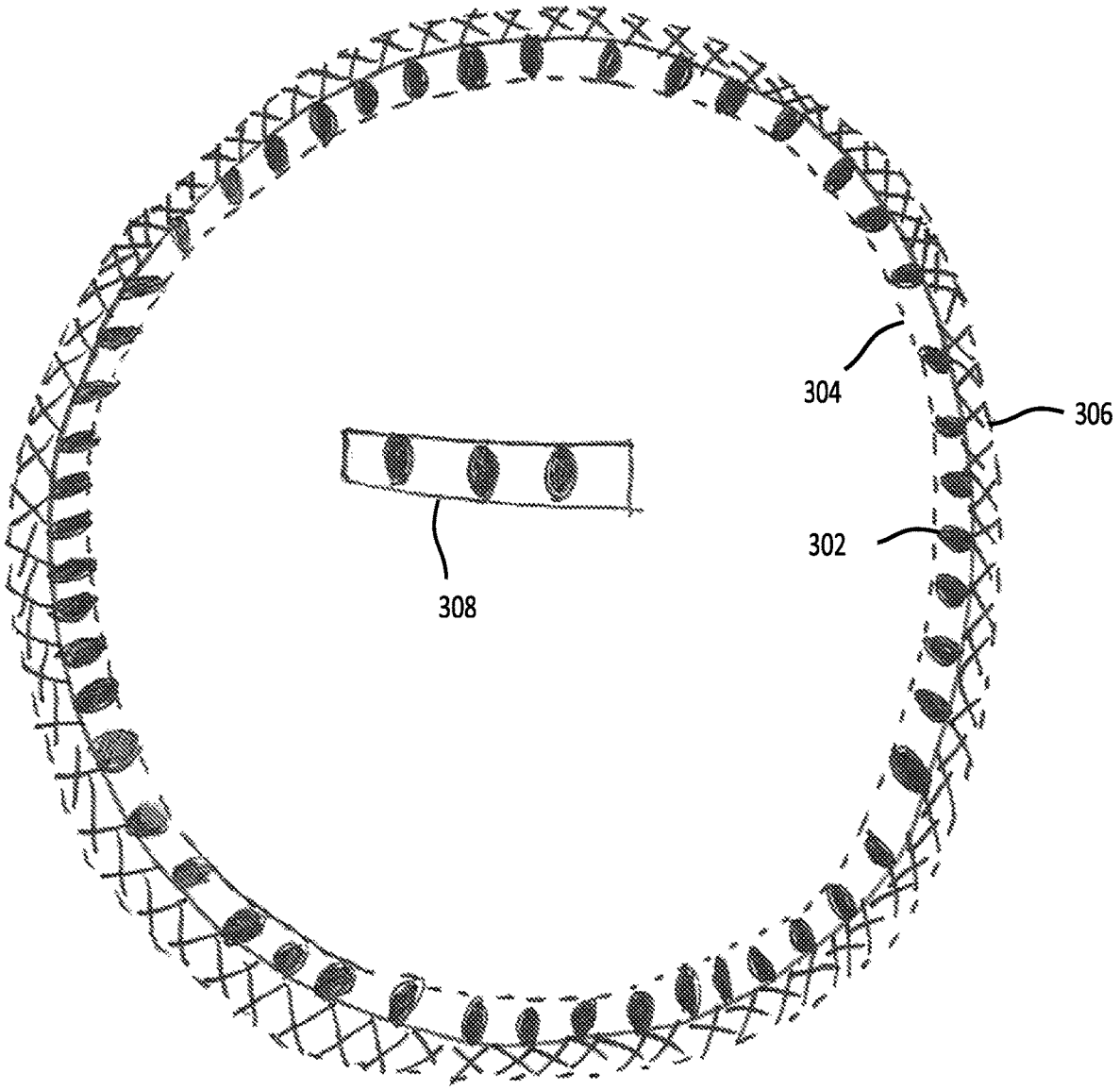
FIG. 3. B.

HAIR PIECE SECURING APPARATUS

BACKGROUND

1. Technical Field

The present disclosure relates to hair pieces, and more specifically to a multi-part hair piece securing device.

2. Introduction

People have worn hair pieces for centuries around the world. They can generally be worn for prosthetic, cosmetics, health issues, religious reasons, or just for convenience. However, a global problem with wearing hair pieces is to securely hold them in place and prevent the hair piece from slipping and moving around. Resolving the latter issue on a background of maintaining the hair piece comfortable and practical for the consumer has not been possible until now.

SUMMARY

Additional features and advantages of the disclosure will be set forth in the description that follows, and in part will be understood from the description, or can be learned by practice of the herein disclosed principles. The features and advantages of the disclosure can be realized and obtained by means of the apparatus and combinations particularly pointed out in the appended claims. These and other features of the disclosure will become more fully apparent from the following description and appended claims, or can be learned by the practice of the principles set forth herein.

A hair piece securing apparatus, comprising a base layer cap, the base layer cap comprising a base cap interior layer; and a base cap exterior layer; an intermediate layer cap, the intermediate layer cap comprising an intermediate cap interior layer; and an intermediate cap exterior layer; and a hair piece, the hair piece comprising a hair piece exterior layer of artificial hair; and a hair piece interior layer; wherein the base layer cap is configured to engage with a human head via the base cap interior layer; the intermediate layer cap is configured to attach to the base cap exterior layer via the intermediate cap interior layer; and the hair piece is configured to attach to the intermediate cap exterior layer via the hair piece interior layer.

An intermediate layer cap for securing hair pieces, comprising an interior surface side configured to attach to a base layer cap, the base layer cap comprising a base cap interior layer; and a base cap exterior layer; and an exterior surface side configured to attach to a hair piece, the hair piece comprising a hair piece exterior layer of artificial hair; and a hair piece interior layer, wherein: the base layer cap is configured to engage with a human head via the base cap interior layer; the intermediate layer cap is configured to attach to the base cap exterior layer via the interior surface side; and the hair piece is configured to attach to the exterior surface side via the hair piece interior layer.

A hair piece securing apparatus, comprising a base layer cap, the base layer cap comprising a base cap interior layer; and a base cap exterior layer, the base cap interior layer comprising multiple base cap exterior loops; an intermediate layer cap, the intermediate layer cap comprising an intermediate cap interior layer, the intermediate cap interior layer comprising multiple interior intermedial hooks; and an intermediate cap exterior layer, the intermediate cap exterior layer comprising multiple exterior intermedial loops; and a hair piece, the hair piece comprising a hair piece exterior layer of artificial hair; and a hair piece interior layer, the hair piece interior layer comprising multiple interior hair piece hooks, wherein the base layer cap is configured to engage with a human head via the base cap interior layer; the intermediate cap interior layer attaches to the base cap exterior layer by coupling the multiple interior intermedial hooks to the multiple base cap exterior loops; the hair piece interior layer attaches to the intermediate cap exterior layer by coupling the multiple interior hair piece hooks to the multiple exterior intermedial loops; a largest circumference of the base layer cap can be adjusted using at least one of a hooks and eye system; a hook and loop fastener; and a drawstring; the multiple interior intermedial hooks of the intermediate cap interior layer can be adjusted in location; and the multiple interior hair piece hooks can be adjusted in location.

BRIEF DESCRIPTION OF THE DRAWINGS

FIG. 2A illustrates an overview of the base layer cap;

FIG. 2B illustrates a cross-over view of the base layer cap:

FIG. 3A illustrates an overview of the intermediate layer cap;

FIG. 3B illustrates a cross-over view of the intermediate layer cap.

DETAILED DESCRIPTION

Figure 1:
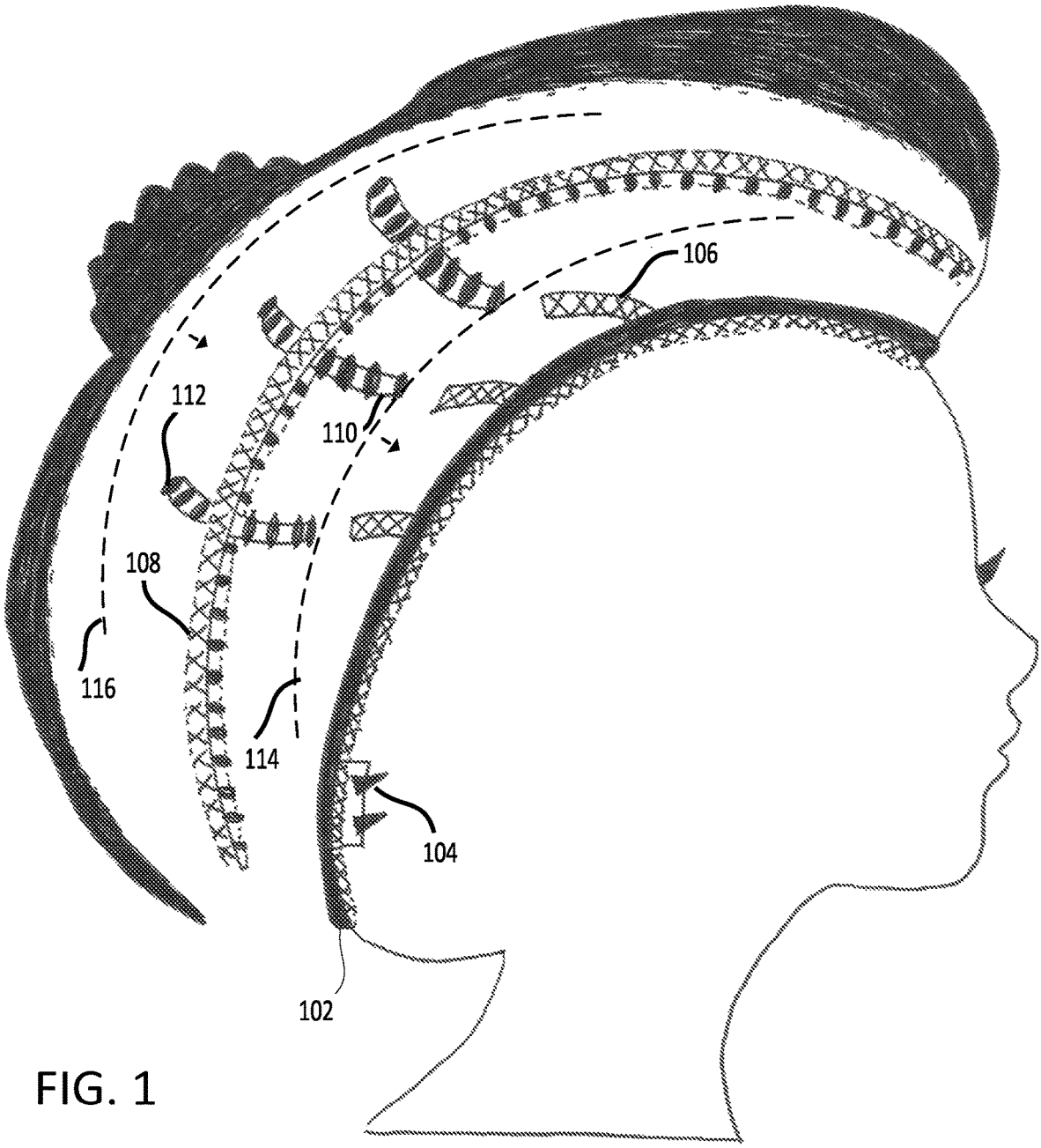
FIG. 1 illustrates an overview of the hair piece apparatus.

Various embodiments of the disclosure are described in detail below. While specific implementations are described, it should be understood that this is done for illustration purposes only. Other components and configurations may be used without parting from the spirit and scope of the disclosure.

Disclosed herein are various hair piece configurations which utilize layers of caps that are equipped with various layers, hooks, loops, hooks and eye system, hook and loop fastener (e.g., VELCRO™), drawstrings, buttons, zippers, clippers, back strap, etc., that allow the hair piece to securely attach to the person's head and stay in place.

The hair piece securing apparatus can utilize at least two layers of caps that can be made of spandex, fabric, lycra, elastic fabric, nylon, silk, cotton, linen, chiffon, velvet, wool, crêpe, satin, polyester, lace, natural fiber, net, organic cotton, organic fiber, organza, breathable fabric, and/or any combination thereof.

In some configurations, the base layer cap and/or the intermediate layer cap can be made to resemble the scalp color of the consumer to provide a more natural look.

To use the hair piece securing apparatus, first, the base layer cap may be placed on the individual's head. The individual may choose any color and/or any fabric base layer cap as desired. To provide a custom fit, the base layer cap may be fitted to the circumference of the individual's head by adjusting the adjustment mechanisms 206, such as a back strap, zipper, button, drawstring, clippers, VELCRO™, etc. At this stage, a multitude of hooks, loops, hooks and eye system, and/or a hook and loop fastener may be free hanging from the exterior later of the base layer cap, ready for the next step. Once the person is satisfied with the fit of the base layer cap, next, the intermediate layer cap may be added. Using the interior layer of the intermediate layer cap, the individual may attach the intermediate layer cap to the exterior layer of the base layer cap by matching the multitude of hooks, loops, hooks and eye system, and/or a hook and loop fastener that may exist on both the interior surface of the intermediate layer cap and the exterior layer of the base layer cap. Once the intermediate layer cap is securely attached to the base layer cap, a multitude of hooks, loops, hooks and eye system, and/or a hook and loop fastener may be free hanging from the exterior layer of the intermediate layer cap. Next, the individual may attach the interior of the hair piece to the exterior layer of the intermediate layer cap. To do this, the individual may use as many or as few of the hooks, loops, hooks and eye system, and/or a hook and loop fastener on the exterior of the intermediate layer cap as needed to attach them to the hair piece of choice, depending on the shape, weight, size, and/or length of the hair piece. Once the hair piece is securely attached, the hair piece securing apparatus is completed.

In some configurations, the base layer cap can be placed on the consumer's head, immediately in contact with the head. The base layer cap can include an interior layer and an exterior layer.

In some configurations, the base layer cap can include a multitude of hooks, loops, hook and eye systems, and/or hook and loop fasteners, on the exterior layer of the base layer cap to allow its attachment to the intermediate layer cap.

The base layer cap can be adjusted to the person's head circumference through adjustment mechanisms such as a back strap, a zipper, a button, a drawstring, clippers, hook and loop fasteners (such as VELCRO™), and/or any other adjustment mechanism, to provide the consumer with flexibility in order to achieve an individual fit for every consumer.

The books, loops, hooks and eye system, hook and loop fastener of the base layer cap can be made of materials such as, for example, plastic, degradable plastic, BPA-free plastic, metal, silicone, and/or any combination thereof.

The intermediate layer can be made of materials such as, for example, spandex, fabric, lycra, clastic fabric, nylon, silk, cotton, linen, chiffon, velvet, wool, crêpe, satin, polyester, lace, natural fiber, net, organic cotton, organic fiber, organza, breathable fabric, and/or any combination thereof.

The intermediate layer cap can include an interior layer and an exterior layer. On either the exterior layer and/or the interior layer, the intermediate cap layer can have hooks, loops, hooks and eye system, and/or a hook and loop fastener, which will allow the attachment of the interior layer of the intermediate cap to the base layer cap, and the attachment of the exterior layer of the intermediate cap to the hair piece.

The books, loops, hooks and eye system, hook and loop fastener of the base layer cap can be made of materials such as plastic, degradable plastic, BPA-free plastic metal, silicone, VELCRO™, and/or other materials, as well as any combination thereof.

The number and location of the hooks, loops, hooks and eye system, hook and loop fastener of either the base layer cap and/or the intermediate layer cap can be adjusted in location as needed. For example, in one configuration, the intermediate cap interior layer can have additional locations configured to receive additional hooks.

In another configuration, at least a portion of the multiple interior intermedial hooks can be removed from the intermediate cap interior layer to allow for personal preferences and adjustments.

The number of hooks, loops, hooks and eye system, hook and loop fastener in the base cap can be modified according to the person's need and preference. For example, in some configurations, the base cap may have more interior intermedial hooks than the intermediate layer cap. In another configuration, the number of the multiple base cap exterior loops of the base cap may exceed the number of multiple interior intermedial hooks of the intermediate cap. In another configuration, the number of the multiple interior hair piece hooks of the hair pieces can be less than the number of multiple interior intermedial hooks of the intermediate cap interior layer of the intermediate layer cap.

FIG. 1 illustrates an example of the hair piece securing apparatus fitted onto a person's head. As illustrated, the hair piece securing apparatus can consist of two cap layers, a base layer cap 102 and an intermediate layer cap 108. The base later cap can consist of an adjuster 104 to provide an individual fit specific to every consumer's head size, which can include a back strap, zipper, button, drawstring, clippers, hook and loop fasteners (such as VELCRO™), and/or other similar adjusting/coupling mechanisms, and may be made from materials such as plastic, degradable plastic, BPA-free plastic metal, silicone, and/or any combination thereof. There can be a multitude of hooks, loops, books and eye system, hook and loop fastener on the exterior layer of the base layer cap 106 that can allow the attachment of the base layer cap to the intermediate layer cap 108 through the multitude of hooks, loops, books and eye system, hook and loop fastener located on the interior layer of the intermediate cap 110. As illustrated in FIG. 1, the locations of these books, loops, hooks and eye system, and/or hook and loop fastener can be flexible and adjusted as needed. The intermediate layer cap can enable the attachment to the hair piece through a multitude of hooks, loops, hooks and eye system, and/or hook and loop fastener located on the exterior layer of the intermediate layer cap 112, through attachment to the interior of the hair piece. The flexibility in number of these hooks, loops, hooks and eye system, hook and loop fastener on the exterior layer of the intermediate cap can allow the person to adjust the hair piece as securely as possible. For example, for a heavier and/or longer hair piece, more hooks, loops, hooks and eye system, hook and loop fastener may be needed. The hooks, loops, hooks and eye system, hook and loop fastener can be attached and adjusted as needed to the exterior layer of the intermediate layer cap 108 as many or as few in number as needed, throughout the exterior layer of the intermediate layer cap. The dashed lines 114 and 116 (including the arrows) identify the perspective from which sectional views of the cap found in FIG. 2B and FIG. 3B should be viewed. Dashed lines 114 and 116 form no part of the invention, and are for clarification purposes only.

FIG. 2A illustrates an example overview of the base layer cap. As illustrated, the base layer cap can consist of an interior layer 204 and an exterior layer 202. The interior layer of the base layer cap can be worn on the person's head. The consumer has the option to adjust the circumference of the base layer cap according to personal preference to ensure optimum fit to the head. For example, this can be done by adjusting the adjustment mechanisms 206, such as a back strap, zipper, button, drawstring, clippers, VELCRO™, etc.

FIG. 2B illustrates an example of cross-sectional view of the base layer cap. As illustrated, the base layer cap can have a multitude of hooks 208, loops, hooks and eye system, hook and loop fastener, and/or other attachment mechanisms.

FIG. 3A illustrates an example of the intermediate layer cap. As illustrated, the intermediate layer cap can consist of an interior layer 304 and an exterior layer 306. The interior layer of the intermediate layer cap can attach to a number of hooks, loops, books and eye system, hook and loop fastener, and/or other attachment mechanisms located on the exterior layer of the base layer cap as needed. Throughout a multitude of hooks, loops, hooks and eye system, hook and loop fastener located on the interior layer of the external layer cap 310, the exterior layer of the intermediate layer cap can attach to the hair piece. As illustrated, the hook and eye system can consist of hooks 306 and complimenting eyes 308 which would allow any hook to attach to any eye.

FIG. 3B illustrates an example of cross-sectional view of the intermediate layer cap. As illustrated, the intermediate layer cap can have an exterior layer that can consist of hooks 306, and an interior layer 304 that can consist of complementing eyes 302. A multitude of eyes can also be located on the interior layer of the intermediate cap 308 to enable the attachment of the intermediate layer cap to the base layer cap.

Use of language such as "at least one of X, Y, and Z," "at least one of X, Y, or Z," "at least one or more of X, Y, and Z," "at least one or more of X, Y, or Z," "at least one or more of X, Y, and/or Z," or "at least one of X, Y, and/or Z," are intended to be inclusive of both a single item (e.g., just X, or just Y, or just Z) and multiple items (e.g., {X and Y}, {X and Z}, {Y and Z}, or {X, Y, and Z}). The phrase "at least one of" and similar phrases are not intended to convey a requirement that each possible item must be present, although each possible item may be present.

The various configurations described above are provided by way of illustration only and should not be construed to limit the scope of the disclosure. Various modifications and changes may be made to the principles described herein without following the example configurations and applications illustrated and described herein, and without departing from the spirit and scope of the disclosure.

I claim:

1. A hair piece securing apparatus, comprising:
- a base layer cap, the base layer cap comprising:
  - a base cap interior layer; and
  - a base cap exterior layer;
- an intermediate layer cap, the intermediate layer cap comprising:
  - an intermediate cap interior layer; and
  - an intermediate cap exterior layer; and
- a hair piece, the hair piece comprising:
  - a hair piece exterior layer of artificial hair; and
  - a hair piece interior layer;
- wherein:
  - the base layer cap is configured to engage with a human head via the base cap interior layer;
  - the intermediate layer cap is configured to attach to the base cap exterior layer via the intermediate cap interior layer; and
  - the hair piece is configured to attach to the intermediate cap exterior layer via the hair piece interior layer;
  - the intermediate cap interior layer comprises multiple interior intermedial hooks;
  - the intermediate cap exterior layer comprises multiple exterior intermedial loops;
  - the hair piece interior layer comprises multiple interior hair piece hooks;
  - wherein the intermediate cap interior layer attaches to the base cap exterior layer by coupling the multiple interior intermedial hooks to the multiple base cap exterior loops; and
  - wherein the hair piece interior layer attaches to the intermediate cap exterior layer by coupling the multiple interior hair piece hooks to the multiple exterior intermedial loops.

2. The hair piece securing apparatus of claim 1, wherein a largest circumference of the base layer cap can be adjusted using at least one of:
- a hooks and eye system;
- a hook and loop fastener; and
- a drawstring.

3. The hair piece securing apparatus of claim 1, wherein the multiple interior intermedial hooks of the intermediate cap interior layer can be adjusted in location.

4. The hair piece securing apparatus of claim 1, wherein the multiple interior hair piece hooks can be adjusted in location.

5. The hair piece securing apparatus of claim 1, wherein the intermediate cap interior layer has additional locations configured to receive additional hooks.

6. The hair piece securing apparatus of claim 1, wherein at least a portion of the multiple interior intermedial hooks can be removed from the intermediate cap interior layer.

7. The hair piece securing apparatus of claim 1, wherein the number of the multiple base cap exterior loops of the base cap exceeds the number of multiple interior intermedial hooks of the intermediate layer cap.

8. The hair piece securing apparatus of claim 1, wherein the number of the multiple interior hair piece hooks of the hair piece exceeds the number of multiple interior intermedial hooks of the intermediate cap interior layer of the intermediate layer cap.

9. The hair piece securing apparatus of claim 1, wherein the number of the multiple interior hair piece hooks of the hair piece is less than the number of multiple interior intermedial hooks of the intermediate cap interior layer of the intermediate layer cap.

10. An intermediate layer cap for securing hair pieces, comprising:
- an interior surface side configured to attach to a base layer cap, the base layer cap comprising:
  - a base cap interior layer; and
  - a base cap exterior layer; and
- an exterior surface side configured to attach to a hair piece, the hair piece comprising:
  - a hair piece exterior layer of artificial hair; and
  - a hair piece interior layer,
- wherein:
  - the base layer cap is configured to engage with a human head via the base cap interior layer;
  - the intermediate layer cap is configured to attach to the base cap exterior layer via the interior surface side; and
    - the hair piece is configured to attach to the exterior surface side via the hair piece interior layer;
  - the intermediate cap interior layer comprises multiple interior intermedial hooks;
  - the intermediate cap exterior layer comprises multiple exterior intermedial loops;
  - the hair piece interior layer comprises multiple interior hair piece hooks;
  - wherein the intermediate cap interior layer attaches to the base cap exterior layer by coupling the multiple interior intermedial hooks to the multiple base cap exterior loops; and
  - wherein the hair piece interior layer attaches to the intermediate cap exterior layer by coupling the multiple interior hair piece hooks to the multiple exterior intermedial loops.

11. The intermediate layer cap of claim 10, wherein a largest circumference of the base layer cap can be adjusted using at least one of:
- a hooks and eye system;
- a hook and loop fastener; and
- a drawstring.

12. The intermediate layer cap of claim 10, wherein the multiple interior intermedial hooks of the interior surface side can be adjusted in location.

13. The intermediate layer cap of claim 10, wherein the multiple interior hair piece hooks can be adjusted in location.

14. The intermediate layer cap of claim 10, wherein the interior surface side has additional locations configured to receive additional hooks.

15. The intermediate layer cap of claim 10, wherein at least a portion of the multiple interior intermedial hooks can be removed from the interior surface side.

16. The intermediate layer cap of claim 10, wherein the number of the multiple base cap exterior loops of the base cap exceeds the number of multiple interior intermedial hooks of the intermediate layer cap.

17. The intermediate layer cap of claim 10, wherein the number of the multiple interior hair piece hooks of the hair piece exceeds the number of multiple interior intermedial hooks of the interior surface side of the intermediate layer cap.

18. A hair piece securing apparatus, comprising:

a base layer cap, the base layer cap comprising:

a base cap interior layer; and a base cap exterior layer, the base cap interior layer comprising multiple base cap exterior loops;

an intermediate layer cap, the intermediate layer cap comprising:

an intermediate cap interior layer, the intermediate cap interior layer comprising multiple interior intermedial hooks; and an intermediate cap exterior layer, the intermediate cap exterior layer comprising multiple exterior intermedial loops; and a hair piece, the hair piece comprising:

a hair piece exterior layer of artificial hair; and a hair piece interior layer, the hair piece interior layer comprising multiple interior hair piece hooks, wherein:

the base layer cap is configured to engage with a human head via the base cap interior layer;

the intermediate cap interior layer attaches to the base cap exterior layer by coupling the multiple interior intermedial hooks to the multiple base cap exterior loops;

the hair piece interior layer attaches to the intermediate cap exterior layer by coupling the multiple interior hair piece hooks to the multiple exterior intermedial loops;

a largest circumference of the base layer cap can be adjusted using at least one of:

a hooks and eye system;

a hook and loop fastener; and a drawstring;

the multiple interior intermedial hooks of the intermediate cap interior layer can be adjusted in location; and the multiple interior hair piece hooks can be adjusted in location.

* * * * *